US009379474B1

(12) United States Patent
McGowan, Jr.

(10) Patent No.: US 9,379,474 B1
(45) Date of Patent: Jun. 28, 2016

(54) SAFETY ELECTRICAL OUTLET DEVICE

(71) Applicant: David L. McGowan, Jr., Pompano Beach, FL (US)

(72) Inventor: David L. McGowan, Jr., Pompano Beach, FL (US)

( * ) Notice: Subject to any disclaimer, the term of this patent is extended or adjusted under 35 U.S.C. 154(b) by 57 days.

(21) Appl. No.: 14/156,332

(22) Filed: Jan. 15, 2014

(51) Int. Cl.
*H01R 13/44* (2006.01)
*H01R 13/516* (2006.01)

(52) U.S. Cl.
CPC ..... *H01R 13/516* (2013.01)

(58) Field of Classification Search
CPC ..... H01R 13/447; H01R 13/4534; H01R 13/5213; H01R 13/4538
USPC ..... 439/136, 137, 145, 140; 174/67
See application file for complete search history.

(56) References Cited

U.S. PATENT DOCUMENTS 3,068,442 A * 12/1962 Kubik et al. ..... 439/136
3,865,456 A * 2/1975 Dola ..... 439/137
4,600,258 A 7/1986 Hu
4,640,564 A * 2/1987 Hill ..... 439/137
4,798,916 A * 1/1989 Engel et al. ..... 174/67
4,886,465 A 12/1989 Warner
4,952,755 A * 8/1990 Engel et al. ..... 174/67
5,026,299 A 6/1991 Foulk
D325,370 S 4/1992 Belcher
5,449,860 A * 9/1995 Buckshaw et al. ..... 174/67
6,222,125 B1 4/2001 Shoemaker
7,098,403 B2 8/2006 Jolley
7,505,237 B2 3/2009 Baxter
2006/0158040 A1 7/2006 McIntosh

* cited by examiner

*Primary Examiner* — Hien Vu
(74) *Attorney, Agent, or Firm* — David P. Lhota, Esq.; Lhota & Associates, P.A.

(57) ABSTRACT

A safety electrical outlet device provides obstruction preventing insertion of objects into an electric outlet. The device includes a housing for coupling to a structure. Electrical contacts on the housing are provided for electrical coupling to electrical supply wiring of the structure. Slots extend through a front face of the housing. The electrical contacts provide electrical current to an electrical plug inserted into the slots. Each of a pair of panels is coupled to the housing and slides between an extended position wherein the panel obstructs an associated one of the slots and a retracted position wherein the associated slot is unobstructed by the panel. Each panel is biased into the extended position. Each of a pair of tabs is coupled to an associated one of the panels and extends from the housing such that manipulation of the tabs moves the panels into the retracted position.

7 Claims, 3 Drawing Sheets

SAFETY ELECTRICAL OUTLET DEVICE

BACKGROUND OF THE DISCLOSURE

1. Field of the Disclosure

The disclosure relates to outlet devices and more particularly pertains to a new outlet device for providing a selectively movable obstruction preventing insertion of objects into an electric outlet.

2. Summary of the Disclosure

An embodiment of the disclosure meets the needs presented above by generally comprising a housing configured for coupling to a structure. Electrical contacts are coupled to the housing for electrical coupling to electrical supply wiring of the structure. Each of a pair of slots extends through a front face of the housing. The electrical contacts provide electrical current to an electrical plug inserted into the slots. Each of a pair of panels is coupled to the housing and slides between an extended position wherein the panel obstructs an associated one of the slots and a retracted position wherein the associated slot is unobstructed by the panel. Each panel is biased into the extended position. Each of a pair of tabs is coupled to an associated one of the panels and extends from the housing such that manipulation of the tabs moves the panels into the retracted position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
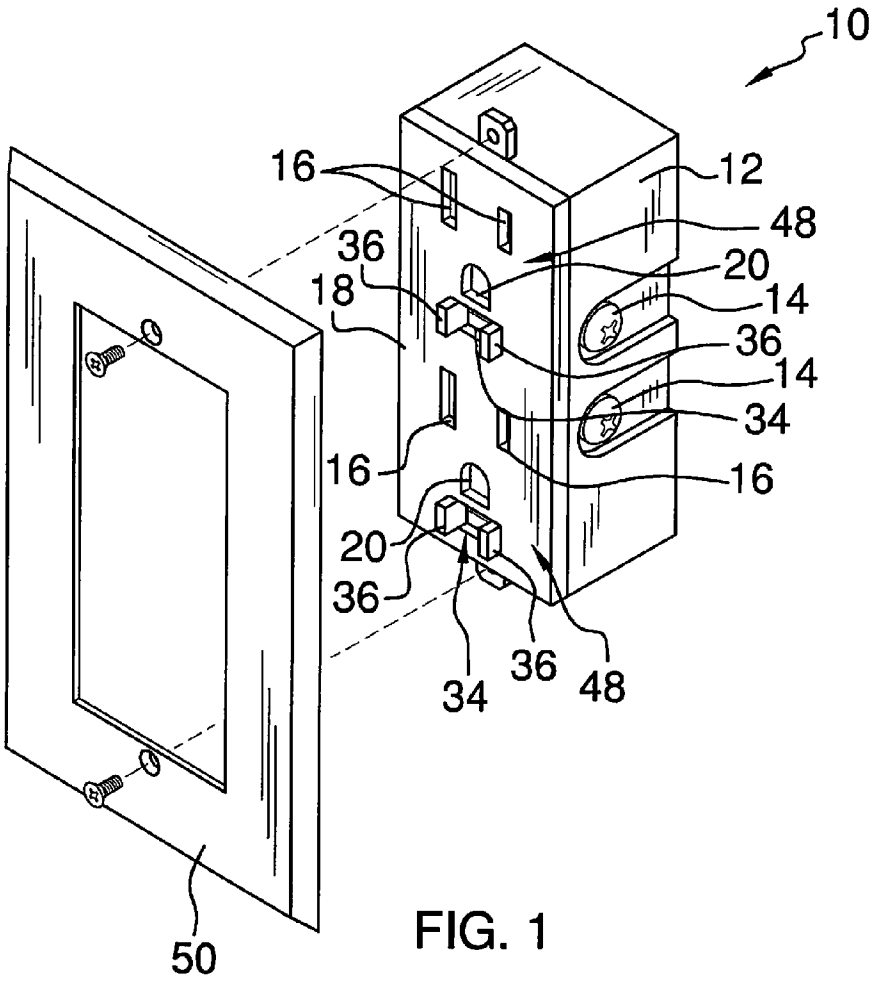
FIG. 1 is a partially exploded top front side perspective view of a safety electrical outlet device according to an embodiment of the disclosure.
Figure 3:
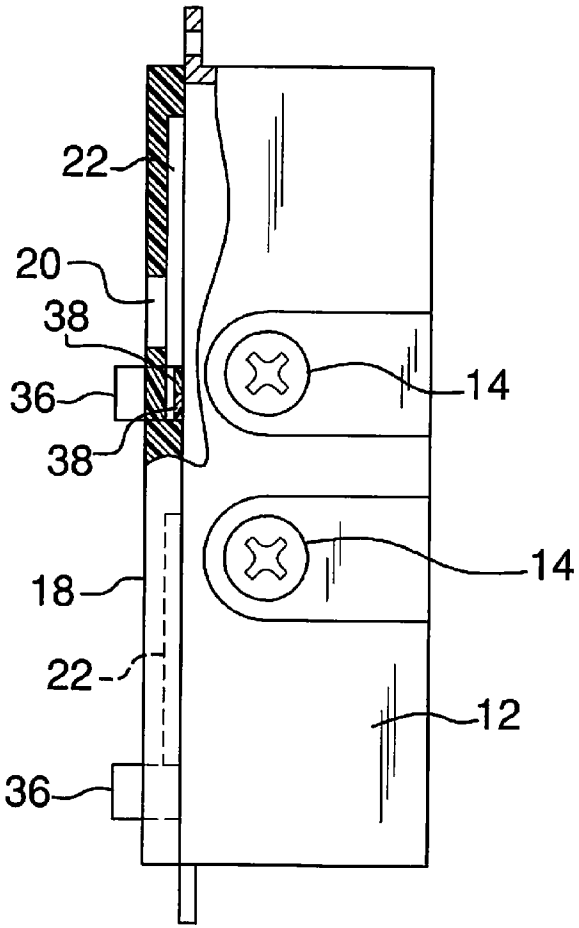
FIG. 3 is a partial cut-away side view of an embodiment of the disclosure taken along line 3-3 of FIG. 2.
Figure 2:
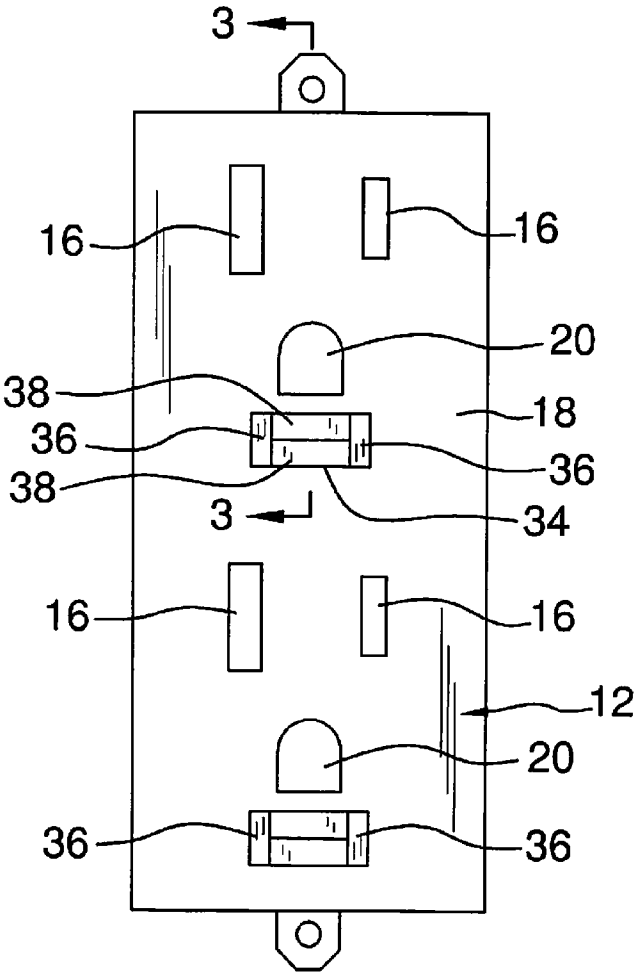
FIG. 2 is a front view of an embodiment of the disclosure.
Figure 5:
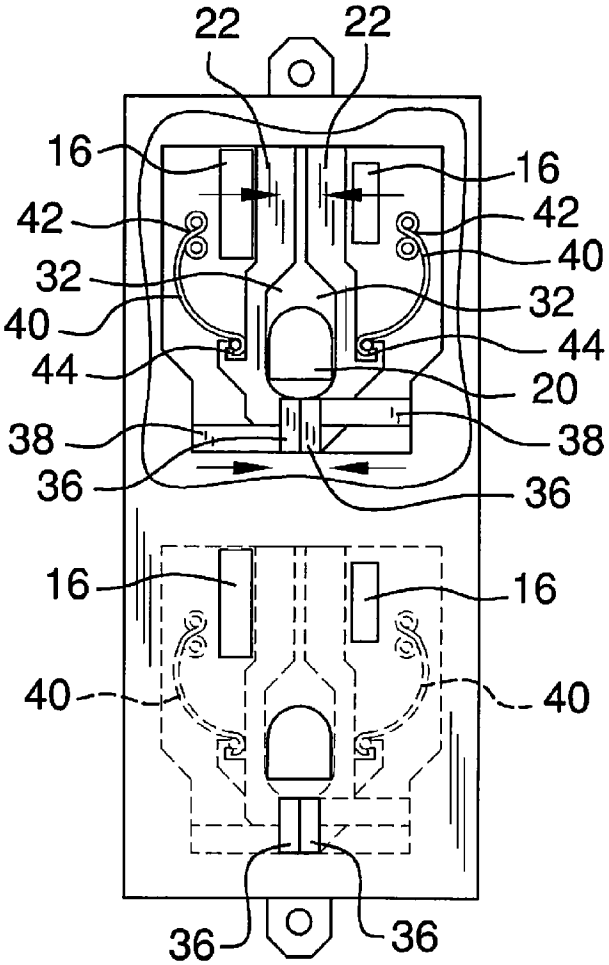
FIG. 5 is a partial cut-away front view of an embodiment of the disclosure.
Figure 4:
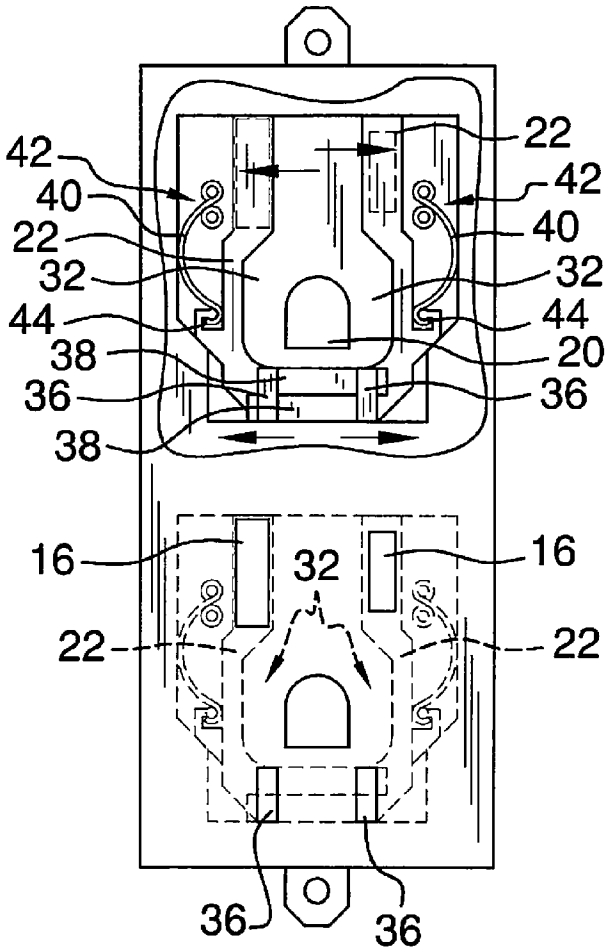
FIG. 4 is a partial cut-away front view of an embodiment of the disclosure.

With reference now to the drawings, and in particular to FIGS. 1 through 5 thereof, a new outlet device embodying the principles and concepts of an embodiment of the disclosure and generally designated by the reference numeral 10 will be described.

As best illustrated in FIGS. 1 through 5, the safety electrical outlet device 10 generally comprises a housing 12 configured for coupling to a structure, building, or the like using known methods for coupling a conventional electrical outlet to a building frame. Electrical contacts 14 are coupled to the housing 12 and configured for electrical coupling to electrical supply wiring of the structure in a conventional manner. A pair of slots 16 extends through a front face 18 of the housing 12. The electrical contacts 14 are configured for providing electrical current to an electrical cord having an electrical plug inserted into the pair of slots 16 in conventional fashion. A ground hole 20 may extend through the front face 18 of the housing 12. The ground hole 20 is positioned between and spaced from the slots 16 wherein the ground hole 20 is configured for receiving a grounding prong extending from the electrical plug when the electrical plug is inserted into the slots 16.

A pair of panels 22 is provided. Each panel 22 is slidably coupled to the housing 12. Each of the panels 22 is positioned in an interior space 24 of the housing 12 against an interior side 26 of the front face 18 of the housing 12. Each panel 22 slides between an extended position 28 wherein the panel 22 obstructs an associated one of the slots 16 and a retracted position 30 wherein the associated slot 16 is unobstructed by the panel 22. Each panel 22 is biased into the extended position 28. Each of the panels 22 has a respective notch 32. Each notch 32 is aligned with the ground hole 20 when the panels 22 are in the extended position 28 wherein the ground hole 20 remains unobstructed by the panels 22 when the panels 22 are in the extended position 28.

A slit 34 extends through the front face 18 of the housing 12. Each of a pair of tabs 36 is coupled to an associated one of the panels 22. Each tab 36 extends from the housing 12 through the slit 34 such that manipulation of the tabs 36 moves the panels 22 into the retracted position 30. Each of a pair of extensions 38 is coupled to and extends between an associated one of the tabs 36 and the associated panel 22. The extensions 38 are adjacently positioned to each other and extend across the slit 34 wherein squeezing the tabs 36 together slides the panels 22 into the retracted position 30.

Each of a pair of springs 40 has a first end 42 coupled to the housing 12. Each spring 40 has a second end 44 coupled to an associated one of the panels 22 wherein the spring 40 urges the associated panel 22 into the extended position 28. The pair of slots 16 and the ground hole 20 define a single electrical socket 48 extending into the housing 12. The electrical socket 48 may be one of a plurality of similarly structured electrical sockets 48 extending into the housing 12 each selectively obstructed by panels 22 as described above. A cover plate 50 may be provided and selectively coupled to the housing 12 in a conventional manner.

In use, the device 10 is attached to the structure and connected to the electrical supply wiring in conventional fashion. The panels 22 obstruct the slots 16 preventing insertion of anything into the slots 16 until the tabs 36 are squeezed together to move the panels 22 to clear the slots 16. When a plug is removed from the slots 16, the panels 22 are biased automatically back into the extended position 28 to obstruct the slots 16. Thus, the device automatically restricts access to a live electrical current enhancing safety for small children.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A safety electrical outlet device for installing in a building structure having electrical supply wiring adapted for electrical coupling and adapted for receiving an electrical plug on an electrical cord, said device comprising:

a housing configured for coupling to a structure;

electrical contacts coupled to said housing, said electrical contacts being configured for electrical coupling to electrical supply wiring of the structure;

a pair of slots extending through a front face of said housing, said electrical contacts being configured for providing electrical current to an electrical cord having an electrical plug inserted into said pair of slots;

a pair of panels, each said panel being slidably coupled to said housing, each said panel sliding between an extended position wherein said panel obstructs one of said slots and a retracted position wherein said one of said slots is unobstructed by said panel, each said panel being biased into said extended position;

each of said panels being positioned in an interior space of said housing;

a pair of tabs, each said tab being coupled to an associated one of said panels, each said tab extending from said housing such that manipulation of said tab moves said panels into said retracted position;

a slit extending through said front face of said housing;

each of said tabs extending outwardly through said slit;

a pair of extensions, each said extension being transversely extended from an associated one of said tabs and in between the associated one of said tabs and opposite with an associated one of said pair of panels, said extensions being adjacently positioned and extending across said slit wherein squeezing said tabs together slides said panels inward into said retracted position; and a pair of springs, each said spring having a first end coupled to said housing, each said spring having a second end coupled to an associated one of said panels wherein said spring urges said associated panel into said extended position.

2. The device of claim 1, further comprising a ground hole extending through said housing, said ground hole being positioned between and spaced from said slots wherein said ground hole is configured for receiving a grounding prong extending from the electrical plug when the electrical plug is inserted into said slots.

3. The device of claim 2, further comprising each of said panels having a respective notch, each said notch being aligned with said ground hole when said panels are in said extended position wherein said ground hole remains unobstructed by said panels when said panels are in said extended position.

4. The device of claim 1, further comprising a cover plate selectively couplable to said housing.

5. The device of claim 1, further comprising said pair of slots defining an electrical socket extending into said housing, said electrical socket being one of a plurality of said electrical sockets extending into said housing.

6. A safety electrical outlet device for installing in a building structure having electrical supply wiring adapted for electrical coupling and receiving an electrical plug on an electrical cord, said device comprising:

a housing configured for coupling to a structure;

electrical contacts coupled to said housing, said electrical contacts being configured for electrical coupling to electrical supply wiring of the structure;

a pair of slots extending through a front face of said housing, said electrical contacts being configured for providing electrical current to an electrical cord having an electrical plug inserted into said pair of slots;

a ground hole extending through said housing, said ground hole being positioned between and spaced from said slots wherein said ground hole is configured for receiving a grounding prong extending from the electrical plug when the electrical plug is inserted into said slots;

a pair of panels, each said panel being slidably coupled to said housing, each of said panels being positioned in an interior space of said housing, each said panel sliding between an extended position wherein said panel obstructs one of said slots and a retracted position wherein said one of said slots is unobstructed by said panel, each said panel being biased into said extended position, each of said panels having a respective notch, each said notch being aligned with said ground hole when said panels are in said extended position wherein said ground hole remains unobstructed by said panels when said panels are in said extended position; and a slit extending through said front face of said housing;

a pair of tabs, each said tab being coupled to an associated one of said panels, each said tab extending from said housing such that manipulation of said tab moves said panels into said retracted position, each of said tabs extending outwardly through said slit;

a pair of extensions, each said extension being transversely extended from an associated one of said tabs and in between the associated one of said tabs and opposite with an associated one of said pair of panels, said extensions being adjacently positioned and extending across said slit wherein squeezing said tabs together slides said panels inward into said retracted position;

a pair of springs, each said spring having a first end coupled to said housing, each said spring having a second end coupled to an associated one of said panels wherein said spring urges said associated panel into said extended position; and a cover plate being selectively couplable to said housing.

7. The device of claim 6, further comprising said pair of slots and said ground hole defining an electrical socket extending into said housing, said electrical socket being one of a plurality of said electrical sockets extending into said housing.

* * * * *